US005732631A

United States Patent [19]

Walther et al.

[11] Patent Number: 5,732,631

[45] Date of Patent: Mar. 31, 1998

[54] METHOD AND DEVICE FOR CLEANING A CYLINDER OF A ROTARY PRINTING MACHINE

[75] Inventors: Thomas Walther, Offenbach; Andreas Lippold, Nidderau, both of Germany

[73] Assignee: MAN Roland Druckmaschinen AG, Germany

[21] Appl. No.: 659,662

[22] Filed: Jun. 6, 1996

[30] Foreign Application Priority Data

Jun. 6, 1995 [DE] Germany ..... 195 20 551.0

[51] Int. Cl.[6] ..... B41F 35/00

[52] U.S. Cl. ..... 101/424; 101/425

[58] Field of Search ..... 101/424, 423, 101/425; 15/256.5, 256.51, 256.52; 451/87, 91, 95, 102

[56] References Cited

U.S. PATENT DOCUMENTS

| | | | |
|---|---|---|---|
| 3,715,838 | 2/1973 | Young et al. | 451/102 |
| 3,737,940 | 6/1973 | Moestue et al. | 15/302 |
| 3,762,950 | 10/1973 | Royka | 15/256.51 |
| 3,769,753 | 11/1973 | Fleischer | 51/11 |
| 4,984,396 | 1/1991 | Urakami | 451/87 |
| 5,109,770 | 5/1992 | Uribe et al. | 101/424 |
| 5,245,925 | 9/1993 | Switall et al. | 101/423 |
| 5,264,904 | 11/1993 | Audi et al. | 15/256.5 |
| 5,385,095 | 1/1995 | Waizmann | 101/424 |
| 5,520,746 | 5/1996 | Kamiya | 134/22.11 |
| 5,552,811 | 9/1996 | Kurata et al. | 347/28 |

FOREIGN PATENT DOCUMENTS

| | | | |
|---|---|---|---|
| 34 030 | 12/1964 | German Dem. Rep. . | |
| 21 59 115 B2 | 3/1976 | Germany . | |
| 41 16 762 A1 | 11/1992 | Germany . | |
| 553076 | 9/1958 | Italy | 451/87 |

OTHER PUBLICATIONS

Prospectus: ACCUSTRIP Denmark APS, DK-5700 Svendborg Norgesvej 10.

*Primary Examiner*—Edgar S. Burr
*Assistant Examiner*—Anthony H. Nguyen
*Attorney, Agent, or Firm*—Leydig, Voit & Mayer, Ltd.

[57] ABSTRACT

A method and apparatus for cleaning cylinders of a rotary printing machine, and particularly rubber-blanket cylinders, back up cylinders, plate cylinders and form cylinders. The cleaning device includes a housing having an orifice on one side and being moveable between throw-on and throw-off positions with respect to the cylinder, at least one jet device for introducing a cleaning agent in the form of pulverulent abrasive into the housing for forceful direction against the surface of the cylinder for removing impurities therefrom, and a suction device in close proximity to the housing orifice for drawing off and removing from the housing used cleaning agent and removed impurities.

21 Claims, 7 Drawing Sheets

METHOD AND DEVICE FOR CLEANING A CYLINDER OF A ROTARY PRINTING MACHINE

FIELD OF THE INVENTION

The present invention relates to a method and apparatus for cleaning printing press cylinders, such as rubber blanket cylinders, back up cylinders, plate cylinders and form cylinders, and more particularly, to a cleaning device which has a housing with an open side or orifice positioned in close relation to the outer cylinder surface to be cleaned.

BACKGROUND OF THE INVENTION

German patent DE 2 159 115 B2 discloses such a cleaning device for printing machine cylinders, which includes a housing having an opening or orifice adjacent the outer cylinder surface and a brush roller which serves as a cleaning element to which cleaning fluid is supplied. The cleaning fluid is atomized during the cleaning process, and the fluid mist, together with contaminated cleaning fluid, is sucked through a return conduit within the housing. For this purpose, a suction fan or pump is used for sucking cleaning fluid mist, as well as the spent cleaning fluid and dirt particles, out from inside the housing.

A prospectus of the company ACCUSTRIP Denmark APS, DK-5700 Svendborg, Norgesvej 10, discloses that intaglio cylinders and rollers may be cleaned in a separate cleaning machine by means of an abrasive composed of sodium bicarbonate. For this purpose, an intaglio cylinder or roller must be introduced into the cleaning machine, the machine is closed, and the abrasive is applied under pressure to the outer surface of the intaglio cylinder or roller by an axially movable nozzle. The contaminated abrasive/ink mixture is collected and disposed of via a drainage system. Disadvantages of this system are the relatively long cleaning time and the complicated demounting and mounting of cylinders or rollers.

OBJECTS AND SUMMARY OF THE INVENTION

It is an object of the present invention to provide a method and apparatus for cleaning printing machine cylinders which is relatively simple and economical in construction and which more effectively removes and disposes of spent cleaning fluid and contaminants cleaned from the cylinders.

Another object is to provide a method and apparatus of the foregoing type which is adapted for more effectively preventing the escape of cleaning fluid particles and particles removed from the cylinder from the housing of the apparatus during usage.

A cleaning device according to the invention consists essentially of a housing open on one side, the opening or orifice of which is facing the printing machine cylinder to be cleaned. The cleaning device can be thrown onto and off the outer surface of the printing machine cylinder and, preferably in the case of printing machine cylinders with gripper bridges, can be lifted off from the cylinder outer surface in the region of the said gripper bridges. A suction extractor is provided in close association with the orifice or opening of the housing. The cleaning method is carried out on the principle of jet cutting, also known as jet lapping. Jet cutting or jet lapping is a chip-removing method with a geometrically indeterminate cutter. In the cleaning method, however, no material is stripped from the cylinder surface, but only the constituents which adhere to the surface, such as ink, varnish or impurities. In this case, a soft pulverulent abrasive is applied by an energy carrier, such as by means of pressurized air or centrifugal force, to the cylinder surface to be cleaned. The pulverulent abrasives are based on carbonates or hydrogen carbonates of the alkali metals. The grains of the abrasive which strike, preferably by means of compressed air, against the surfaces of the printing machine cylinders to be cleaned, and preferably each individual grain of the abrasive, burst into a multiplicity of particles which are themselves in turn cutting grains. These cutting grains in turn have a multiplicity of geometrically indeterminate cutters and are entrained by the energy carrier preferably more than once, so that the pulverulent abrasive strikes against the cylinder surface once as a whole grain and subsequently strikes the cylinder surface to be cleaned at least once more as particles. However, when the abrasive strikes the cylinder surface in particles, the impact velocity is lower than when abrasives are supplied in grain form by means of compressed air or under centrifugal force. The grains and the particles pick up the constituents, such as ink, varnish, fluff or other dirt, adhering to the surface and/or strip these from the surface. The surface itself of the printing machine cylinder is not at the same time stripped.

An advantage of the invention is that there is no need for conventional liquid solvents for the cleaning process. The non-liquid cleaning agent in the form of a pulverulent abrasive can be more easily handled and directed. Pulverulent dust, moreover, is prevented from escaping into the environment as a result of a suction extraction. This prevents soiling of the printing machine and adversely affecting the work environment. While alternatively water may be used for transporting away the removed and contaminated abrasive materials, preferably, the abrasive is removed from the housing by suction extraction since the pulverulent abrasive remains dry.

Other objects and advantages of the invention will become apparent upon reading the following detailed description and upon reference to the drawings, in which:

Figure 1:
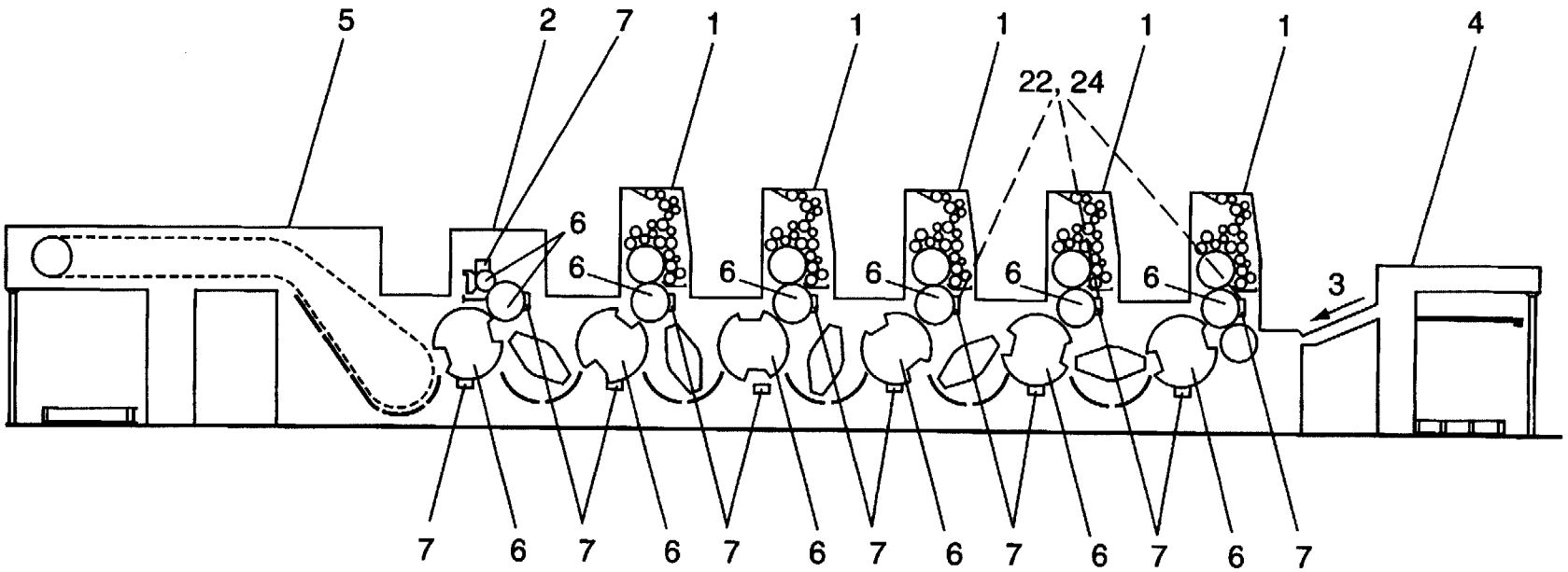
FIG. 1 is a diagrammatic depiction of a printing machine having cylinder cleaning devices in accordance with the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Figure 2:
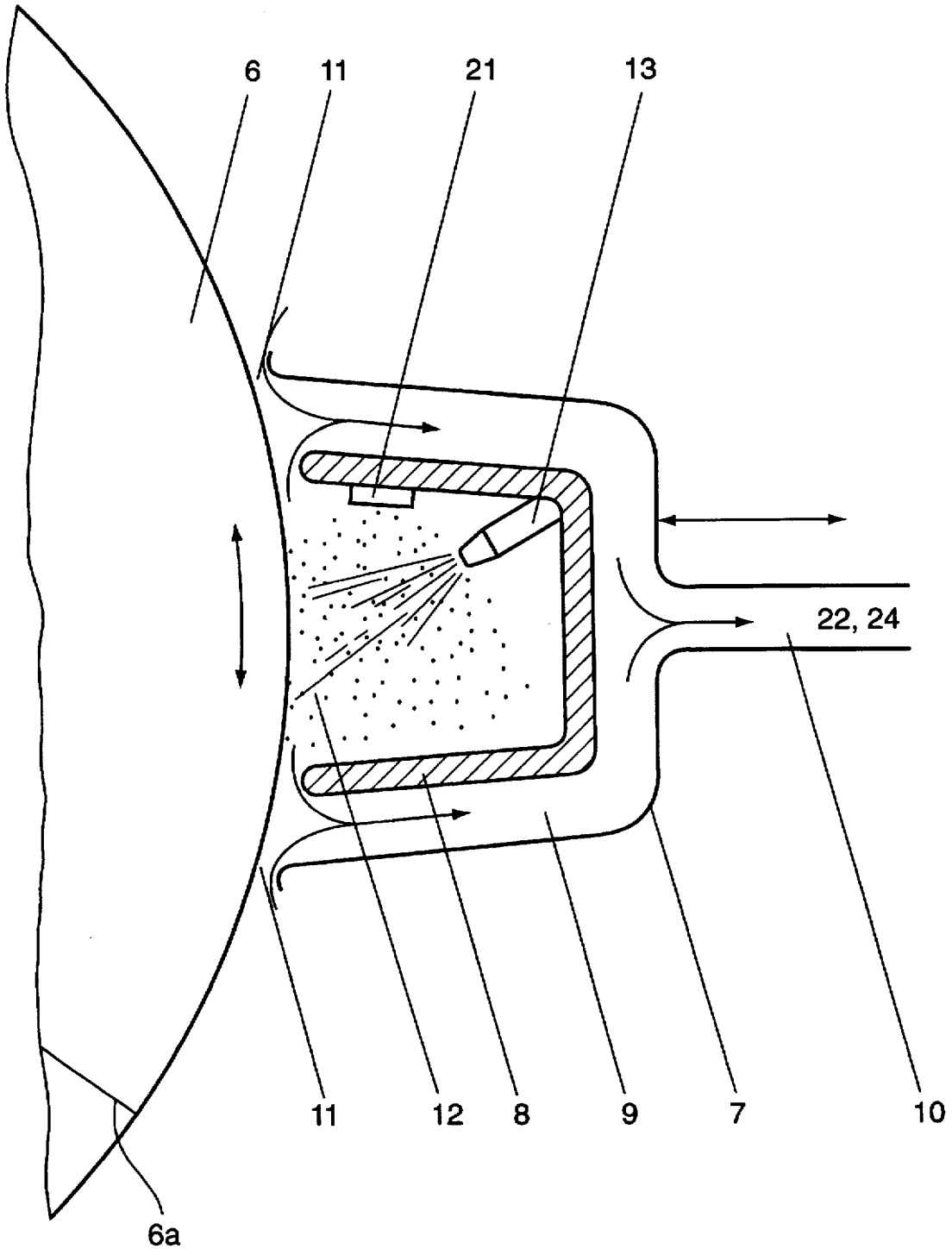
FIG. 2 is an enlarged fragmentary section of one of the cylinder cleaning devices included in the printing machine shown in FIG. 1.

Referring now more particularly to FIGS. 1 and 2 of the drawings, there is shown an illustrative printing machine having cleaning units embodying the present invention. The printing machine in this instance includes five printing units 1 and a varnishing unit 2 located downstream in the sheet running direction. The printing machine further includes a feeder 4 at the upstream end and a delivery unit 5 at the downstream end. Each printing unit includes, inter alia, a rubber-blanket cylinder and a backup cylinder of the conventional type which are designated herein as printing machine cylinder 6. Each printing machine cylinder 6 has a respective cleaning device 7. The varnishing unit 2 includes, inter alia, a form cylinder and a backup cylinder which are likewise designated herein as printing machine cylinder 6. The varnishing unit may also include a screen roller, which similarly may be considered a printing machine cylinder herein.

Each cleaning device 7 includes a housing 8 that is substantially rectangular in cross section and extends over the entire width of the printing machine cylinder 6. The housing 8 has an opening which defines an orifice 12 on one side thereof that is positionable into adjacent relation to the printing machine cylinder 6. The housing 8 is moveable by appropriate means between the throw-off position removed from the printing machine cylinder and a throw-on position in closely adjacent the printing machine cylinder with a relatively small gap 11 therebetween. A row of nozzles 13 are mounted in the housing, or alternatively, a single nozzle may be provided that is axially moveable by appropriate means. Preferably, at least one fluid supply 21 for water also is mounted within the housing.

In accordance with the invention, a pulverulent abrasive is forcefully directed through the nozzles into the housing and against the printing cylinder, by means of an energy carrier, such as compressed air, so as to remove contaminants from the surface of the printing cylinder by means of jet cutting or lapping. The pulverulent abrasive may consist of sodium hydrogen carbonate or at least contain such material. The abrasive preferably is soft, fine-grained and water soluble and will break up into relatively small abrasive particles upon impact with the printing cylinder surface.

To prevent channel **6*a* in the cylinder from being contaminated, the pulverulent abrasive preferably is directed onto the printing cylinder surface at predetermined angular positions of the cylinder determined by front or rear edges of the channels 6*a*, with operation of the cylinders being controlled by an appropriate control 25, as diagrammatically depicted in FIG. 1. One skilled in the art will appreciate that the control 25** can be operated in response to sensing edges of the cylinder channels during rotation thereof, or alternatively, by monitoring the rotational position of the cylinders. Control of the operation of the introduction of the pulverulent abrasive in such manner prevents the cylinder channel from being soiled. Under control from a control desk, the supply of abrasive material may be stopped with reference to the angular position of the cylinder channel.

In keeping with the invention, a suction extractor 9 is provided at the gap 11 about the orifice 12 of the housing for withdrawing from the housing expended pulverulent abrasive and contaminants removed from the cylinder. The suction extractor 9 in this case encloses the housing 8 and defines a passageway about the housing communicating with a conduit 10 connected to an appropriate suction source 24 and disposal means 22 for the abrasive. Alternatively, the housing can be connected to a treatment system for treating and purifying the removed pulverulent abrasive and permitting it to be recirculated through the nozzles 13. As illustrated in FIG. 2, pulverulent abrasive and pressurized air may be supplied to the nozzles 13 for repeatedly impinging the abrasive materials against the surface of the cylinder for removing contaminants, with the abrasive particles and contaminants ultimately being drawn through the small space between the end of the housing 8 into the flow passageway defined by the suction extractor 9 and through the conduit 10 to the exhaust or re-treatment system.

Figure 3:
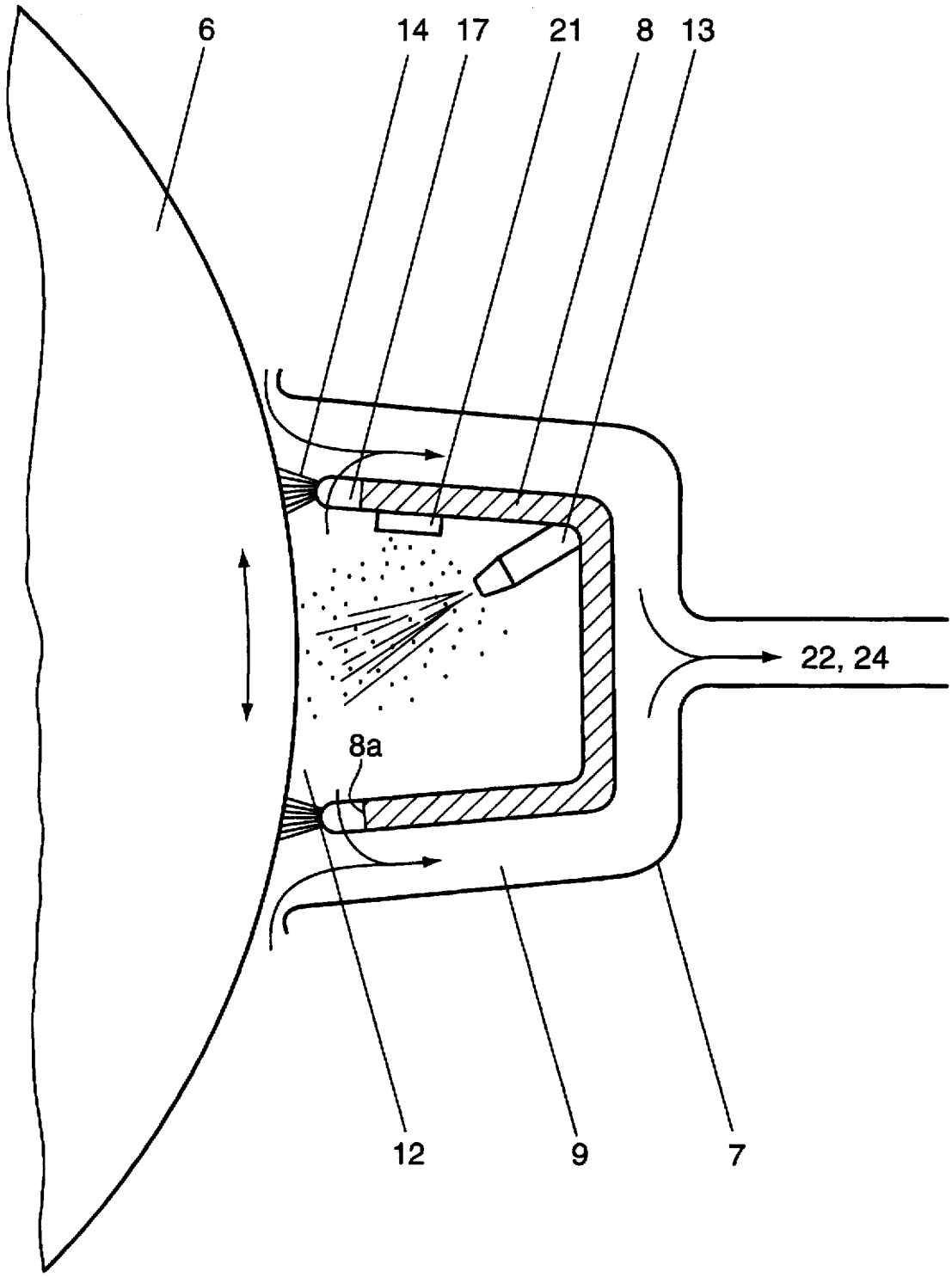
FIGS. 3–7 show various alternative embodiments of the cleaning device.
Figure 4:
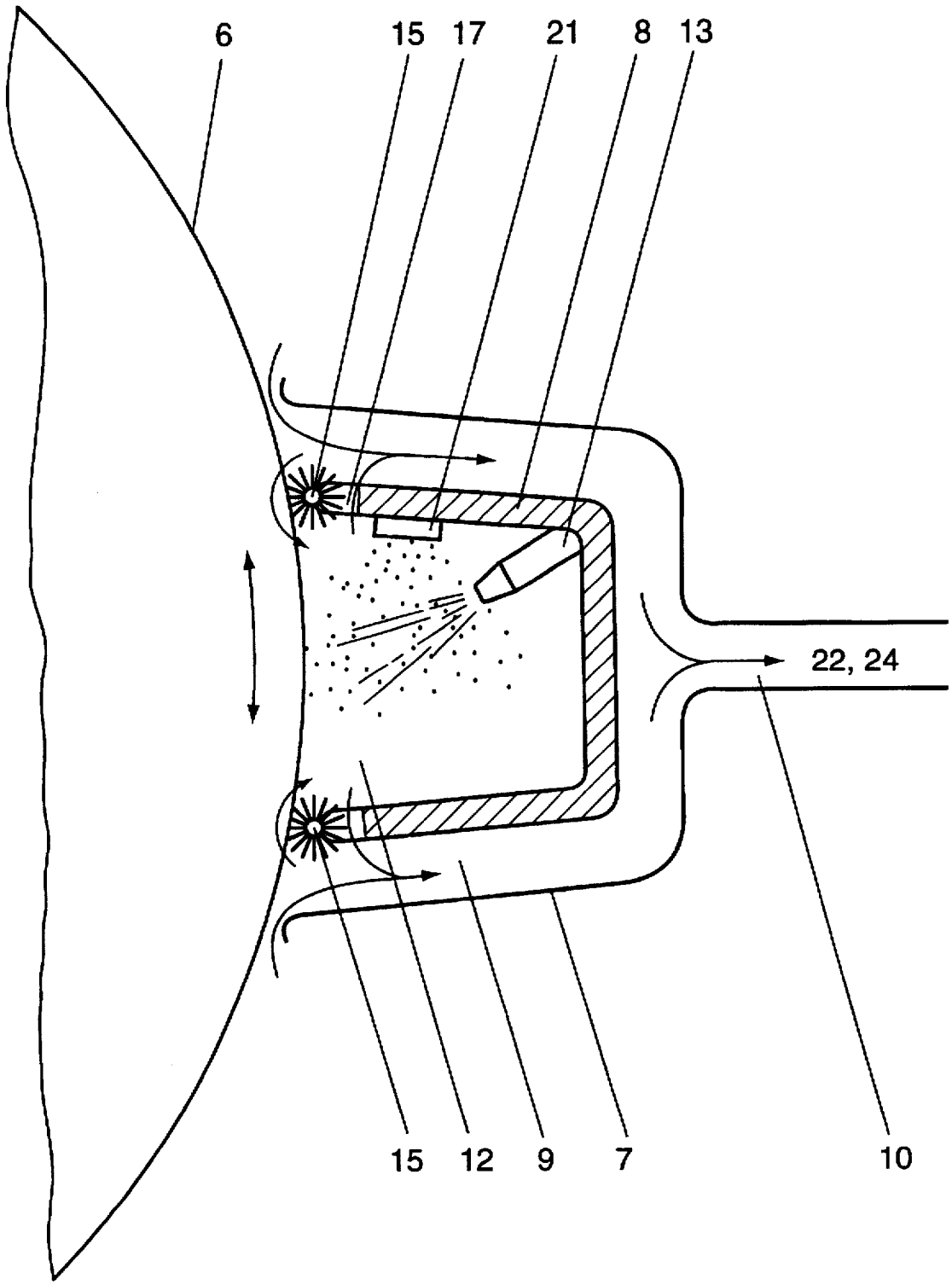
Figure 5:
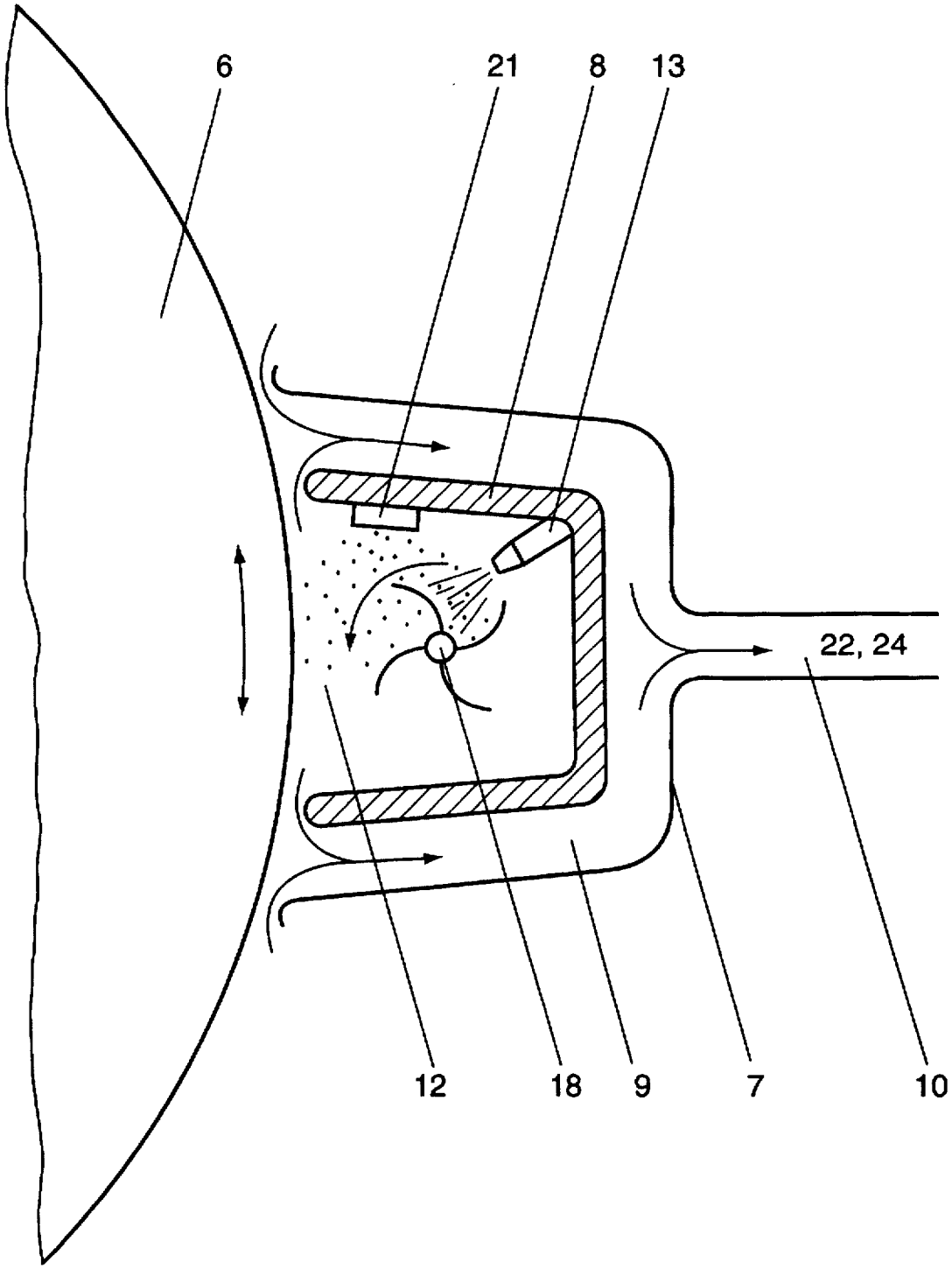
Figure 6:
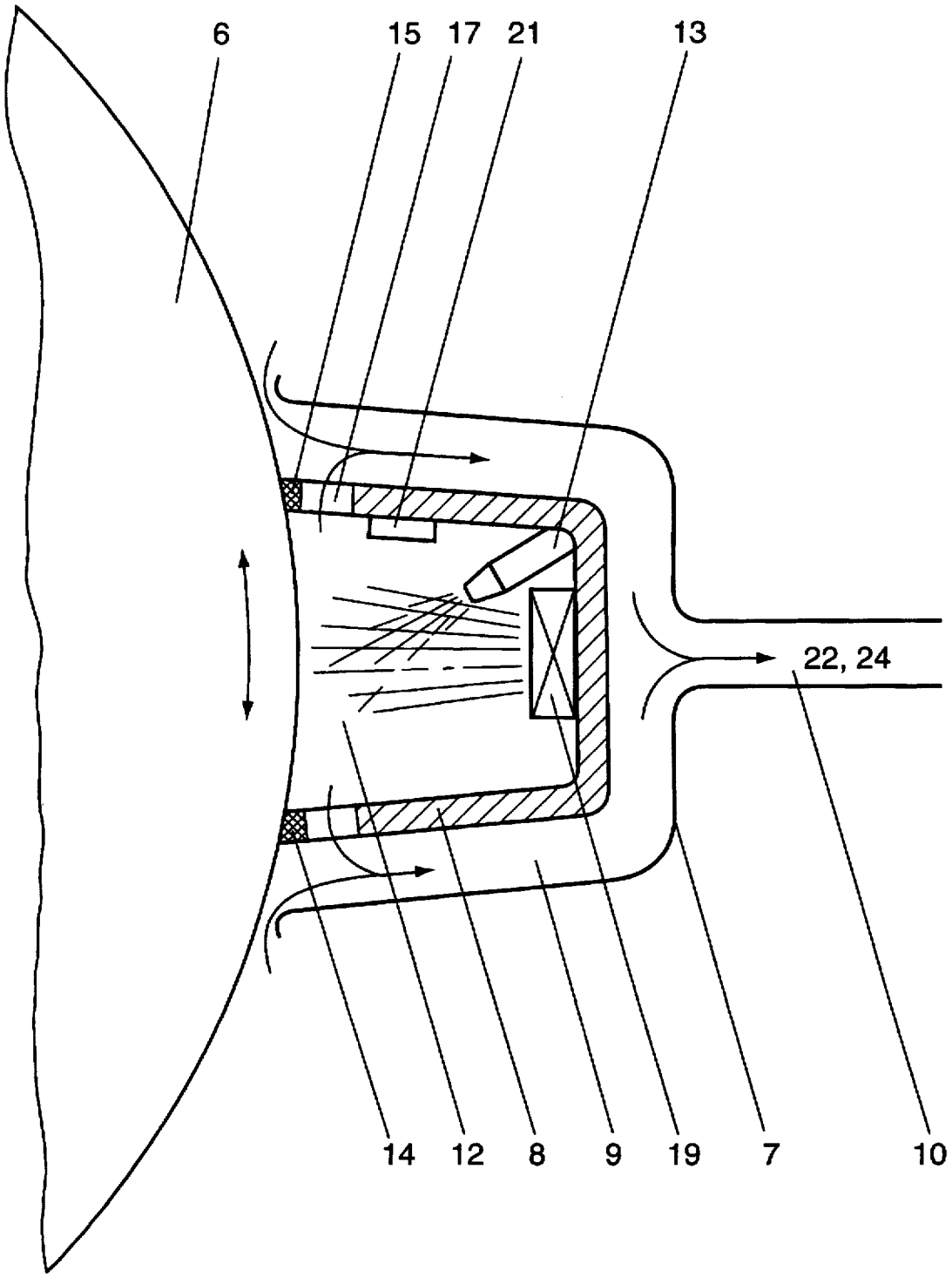

Alternative embodiments of the cleaning device are shown in FIGS. 3–7 wherein similar items have been given similar reference numerals. In the embodiment of FIG. 3, the orifice 12 of the housing 8 has an elastic sealing member 14 extending outwardly of the housing and engaging the surface of the printing machine cylinder 6. Alternatively, the sealing member may be mounted on the suction extractor 9. The sealing member serves to seal off the housing interior relative to the environment so as to prevent the escape of pulverulent abrasive particles and removed contaminants into the environment. The sealing member 14 may be a brush, as indicated in FIG. 3, or a flexible elastomeric lip, as shown in FIG. 6. Passages **8*a*** communicate through the end of the housing for permitting the withdrawal of the pulverulent abrasives and removed contaminants from the housing by the suction extractor.

With reference to the embodiment of FIG. 4, the cleaning device includes power driven, rotatable brushes 15 mounted on the end of the housing 8 in parallel relation to the printing machine cylinder 6. The brushes are coupled to an appropriate power drive, and preferably are rotated in opposite directions so as to direct removed contaminants and particles from the cylinder into the housing 8.

In the embodiment of FIG. 5, pulverulent abrasive material introduced through the nozzles 3 from a supply conduit is forcefully directed against the printing machine cylinder by means of centrifugal forces generated by a centrifugal rotating wheel 18 mounted within the housing 8. The centrifugal rotary wheel 8 may be power driven by an appropriate motor.

With further reference to the embodiment of FIG. 6, a separate auxiliary pneumatic system 19 is provided, such as a roll of fans, for the purpose of forcefully directing pulverulent abrasive materials introduced into the housing through the nozzles 13 against the surface of the cylinder.

Figure 7:
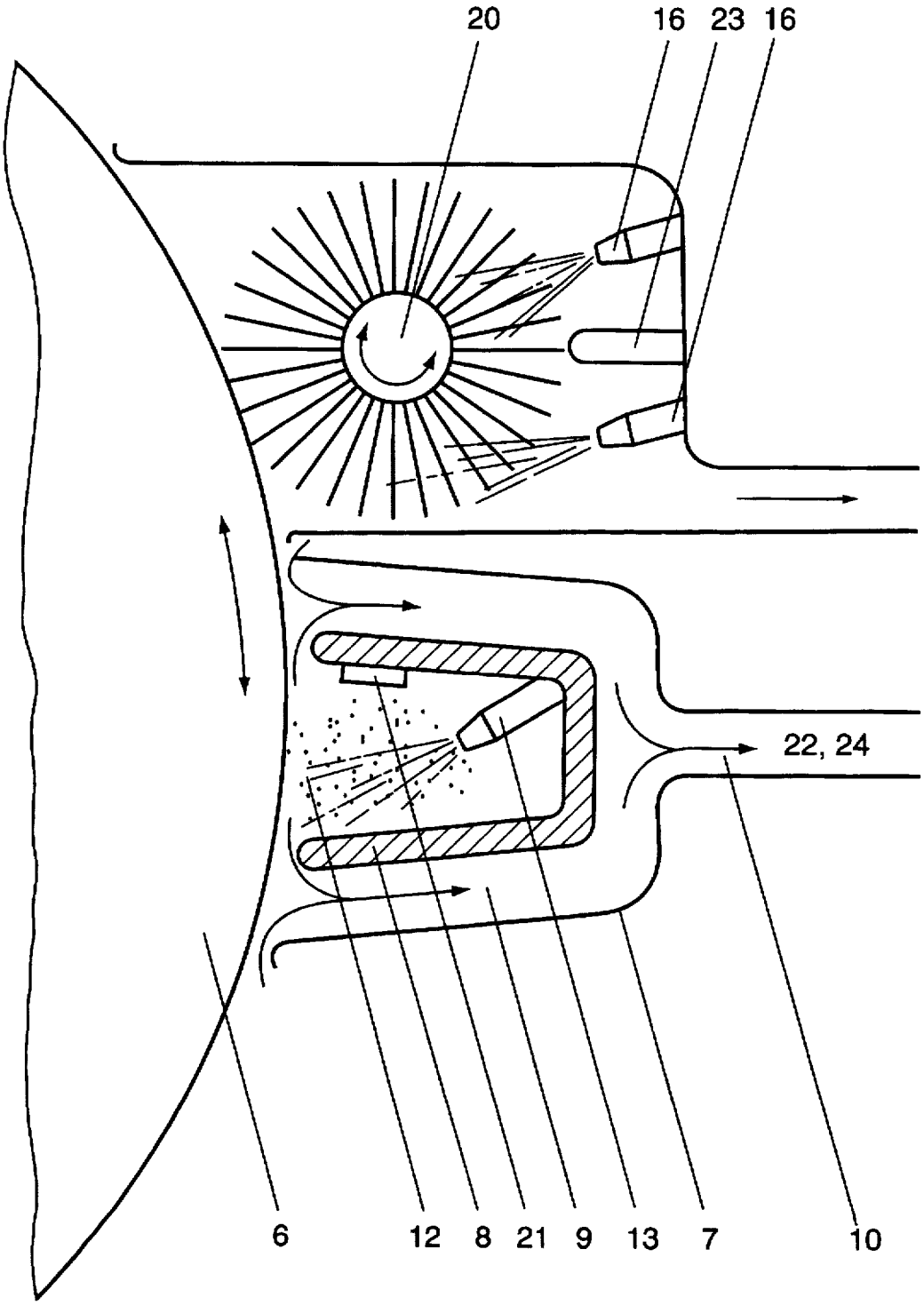

In the embodiment of FIG. 7, the cleaning device 7 is combined with a conventional cleaning device for printing machine cylinders. In this case, the conventional cleaning device has a cleaning element 20, for example, a washing brush. Furthermore, spray nozzles 16 for the supply of cleaning fluid, for example based on vegetable washing agents and water, are provided. A doctor 23 acts as a stripper for the cleaning element 20. The conventional cleaning device possesses, furthermore, a discharge for the contaminated cleaning fluid.

It will be seen that during operation of the printing machine, the cleaning device is normally located in a position thrown off from the printing machine cylinder 6. When the outer surface of the printing machine cylinder 6 is to be washed, the row of nozzles 13 is supplied in a controlled manner with pulverulent abrasive. The pulverulent abrasive is transported pneumatically or by means of the centrifugal wheel to the surface of the printing machine cylinder 6 to be cleaned. There, it strikes against the ink/varnish/dirt particles and essentially tears these off from the cylinder surface. On impact, each grain of the abrasive bursts into a multiplicity of particles (of smaller grain size) and once again strikes with reduced energy against the surface of the printing machine cylinder 6 and, at the same time, once more strips ink/varnish/dirt particles. This can take place more than once, the suction extractor 9 being coupled to a suction source. In the case of gripper bridges on the printing machine cylinder, the cleaning device 7 is lifted out in this region. Air is brought from the environment via the gap 11 and ink residues, fluff and the pulverulent abrasive itself, as well as other dirt residues, are sucked off from inside the housing 8 via the suction extractor 9 and the conduit system 10 from the suction source 24. The conduit system 10 preferably is interlinked so that each cleaning device 7 in the printing machine is connected to a common suction source 24 and disposal system 22 (See FIG. 1). When the cleaning process has ended, the cleaning device 7 is thrown off from the printing machine cylinder 6. The supply of pulverulent abrasives and the suction source 24 are then stopped.

In the case of printing machine cylinders 6 having at least one cylinder channel 6*a*, the supply of the pulverulent abrasive is stopped, upstream of the front edge of the cylinder channel in the direction of rotation of the cylinder 6, until the rear edge of the cylinder channel is reached. The contaminated abrasive is sucked off simultaneously. After the cylinder channel has passed, pulverulent abrasive is supplied again and continues to be sucked off. To terminate the cleaning process, the supply of pulverulent abrasive is stopped and the abrasive remaining inside the housing is disposed of via the suction extractor 9. As shown in FIG. 2, to speed up the disposal of the abrasive from inside the housing 8, the fluid feed 21 is additionally provided. After the supply of abrasive via the nozzles 13 has been stopped, water is sprayed into the housing via the fluid feed 21. The pulverulent abrasive is thereby precipitated in the housing 8 and can be washed out via the suction extractor 9.

What is claimed is:

1. A method for cleaning a cylinder of a rotary printing machine with a cleaning device comprising the steps of providing a housing which can be thrown onto and off the rotating cylinder and which has an orifice for positioning in closely adjacent relation about a portion of an outer cylindrical surface of the cylinder and at least one spraying device for supplying a non-liquid cleaning agent, positioning the spraying device housing with the orifice thereof in closely adjacent relation about a portion of the outer cylindrical surface of the cylinder, introducing non-liquid cleaning agent in the form of a pulverulent abrasive through the spraying device, forcefully impinging the pulverulent abrasive against the portion of the outer cylindrical surface of the cylinder about which the housing is positioned to strip and remove impurities adhering to the outer cylindrical surface without stripping material that defines the outer cylindrical surface of the cylinder, and sucking out from the housing the pulverulent abrasive after impingement with the cylindrical surface and the removed impurities.

2. The method of claim 1 in which said pulverulent abrasive is introduced through the device into the housing and forcefully directed against the cylinder by pressurized air.

3. The method of claim 1 in which said pulverulent abrasive is forced upward against the surface of the cylinder by centrifugal forces generated within the housing subsequent to the introduction of pulverulent abrasive material through the device.

4. The method of claim 1 in which said pulverulent abrasive is introduced into the housing in a controlled manner dependent upon the angular position of the cylinder.

5. The method of claim 4 in which a fixed angular position of the cylinder is determined by a front edge of a channel in the cylinder in the direction of rotation of the cylinder.

6. The method of claim 4 in which a fixed angular position of the cylinder is determined by a rear edge of a channel in the cylinder in the direction of rotation of the cylinder.

7. The method of claim 5 in which the introduction of pulverulent abrasive is interrupted in the region of the cylinder channel.

8. The method of claim 1 in which following the introduction of the pulverulent abrasive and removal of impurities from the cylinder water is introduced into the housing from a separate supply, and pulverulent abrasive removed impurities, and water are removed by suction from the housing.

9. A method of claim 1 including forcefully impinging the pulverulent abrasive against the outer surface of the cylinder during rotary movement of the cylinder.

10. A device for cleaning an outer cylindrical surface of a cylinder of a rotary printing machine comprising a housing which is moveable between a throw-off position in removed relation to the rotating cylinder and a throw-on position in closely adjacent relation to the cylinder, said housing having an orifice in a side thereof positionable into closely adjacent relation about a portion of the outer cylinder surface of the cylinder when the housing is in the throw-on position, a jet device for introducing a non-liquid cleaning agent in the form of pulverulent abrasive into the housing against the portion of the outer cylindrical surface of the cylinder about which the housing is closely positioned for removing impurities from the cylindrical surface without stripping material that defines the outer cylindrical surface of the printing machine cylinder, and a suction extractor separated from an inside of the housing for removing impurities and pulverulent abrasive after impingement with the cylindrical surface.

11. The device according to claim 10 in which the suction extractor surrounds the orifice of the housing.

12. The device according to claim 11 in which said suction extractor is disposed about the outside of the housing.

13. The device according to claim 12 in which the suction extractor and housing define flow passageways through which pulverulent abrasive and impurities are drawn under suction pressure from said housing.

14. The device according to claim 13 in which said suction extractor is connected to a downstream disposal device and a suction source by a conduit.

15. The device according to claim 10 including at least one rotating brush arranged in the region of the housing orifice.

16. The device according to claim 10 including a centrifugal wheel mounted within the housing for directing pulverulent abrasive introduced into the housing from the jet device against the printing cylinder surface by centrifugal force.

17. The device according to claim 10 including a pneumatic system within the housing for forcefully directing pulverulent abrasive introduced into the housing from the jet device against the surface of the printing machine cylinder.

18. The device according to claim 10 in which the jet device introduces pulverulent abrasive in the form of carbonates into the housing.

19. The device according to claim 10 in which the jet device introduces pulverulent abrasives in the form of hydrocarbons of alkali metals into the housing.

20. The device according to claim 10 in which the jet device introduces pulverulent abrasives in the form of sodium hydrogen carbonate into the housing.

21. A printing machine comprising a plurality of printing cylinders each having an outer cylindrical surface over which sheets pass during a printing operation, a cleaning device associated with each cylinder, said cleaning devices each including a housing which is moveable between a throw-off position in removed relation to the rotating cylinder and a throw-on position in closely adjacent relation to the cylinder, said housing having an orifice in a side thereof positionable into closely adjacent relation about a portion of the outer cylindrical surface of the cylinder when the housing is in the throw-on position, a jet device for introducing a non-liquid cleaning agent in the form of pulverulent abrasive into the housing and against the portion of the outer cylindrical surface of the cylinder about which the housing is positioned for removing impurities from the cylindrical surface of the printing machine cylinder without stripping material that defines the outer cylindrical surface of the cylinder, a suction extractor separated from an inside of the housing for removing impurities and pulverulent abrasive after impingement with the cylindrical surface, a common suction source and pulverulent abrasive disposal system, and said suction extractors for each cleaning device being coupled to said common suction source and disposal system.

* * * * *